United States Patent [19]

Alandy

[11] Patent Number: 4,653,589

[45] Date of Patent: Mar. 31, 1987

[54] MUDLINE CASING HANGER TIEBACK ADAPTOR WITH ADJUSTABLE LOAD RING

[75] Inventor: Jose M. Alandy, Camarillo, Calif.

[73] Assignee: Vetco Gray Inc, Ventura, Calif.

[21] Appl. No.: 745,052

[22] Filed: Jun. 17, 1985

[51] Int. Cl.[4] ..... F21B 33/043

[52] U.S. Cl. ..... 166/382; 166/348; 166/208; 285/139

[58] Field of Search ..... 166/381, 382, 348, 349, 166/339, 208, 183; 285/133 A, 133 R, 137 R, 133 A, 139, 140, 18, 348

[56] References Cited

U.S. PATENT DOCUMENTS

| | | | |
|---|---|---|---|
| 3,797,864 | 3/1974 | Hynes et al. | 285/140 |
| 3,871,449 | 3/1975 | Ahlstone | 285/140 X |
| 4,453,745 | 6/1984 | Nelson | 285/18 |
| 4,465,134 | 8/1984 | Watkins | 166/123 X |
| 4,561,499 | 12/1985 | Berner Jr. et al. | 166/384 X |
| 4,595,053 | 6/1986 | Walkins et al. | 166/382 X |

FOREIGN PATENT DOCUMENTS

| | | | |
|---|---|---|---|
| 81/02441 | 9/1981 | PCT Int'l Appl. | 285/139 |
| 2032561 | 5/1980 | United Kingdom | 166/348 |

*Primary Examiner*—Stephen J. Novosad
*Assistant Examiner*—David J. Bagnell
*Attorney, Agent, or Firm*—Joseph R. Dwyer

[57] ABSTRACT

A method and apparatus comprising a mudline casing hanger tieback adaptor with an adjustable load ring for connecting an installed subsea wellhead on the mudline suspension system.

The mudline casing hanger tieback adaptor (180) includes a mudline hanger adaptor body (182) with an adjustable load ring 184, a packoff nut (104) and packoff (102), casing pup (186), and a tieback tool (190), all of which are lowered on a running tool to be connected to an already installed subsea wellhead (80) and sealably connected to an already installed casing hanger (64) on the innermost casing of a mudline supsension system. The adjustability of the load ring compensates for any tolerance buildup in the already installed casing (32) and adjustably shouldering the load ring (184) on the wellhead (80) transfers the load imposed on the innermost tieback tool (190) and casing hanger (70) back to the wellhead (80) during the high pressure testing of the packoff seal (202) between the tieback tool (190) and casing hanger. The annulus (200) between the mudline casing hanger tieback adaptor (180) and the wellhead (80) is sealed by setting the packoff (202) and the latter is locked down by an adaptor lockdown mechanism (234) threaded into the bore of the wellhead.

13 Claims, 6 Drawing Figures

MUDLINE CASING HANGER TIEBACK ADAPTOR WITH ADJUSTABLE LOAD RING

BACKGROUND OF THE INVENTION

Related Application

The U.S. application for patent entitled "Lockdown Connector For Mudline Wellhead Tieback Adaptor" filed even date herewith Ser. No. 745,049 by Jose M. Alandy.

Field of Invention

This invention relates, in general, to subsea well systems and is directed to a method and apparatus for converting a mudline suspension system to a subsea wellhead system. More specifically, this invention is directed to a method and apparatus for connecting the innermost casing hanger to a wellhead already installed in a mudline suspension system in such a manner that all loads to be imposed on the innermost casing hanger are transferred to the wellhead and the annular space between the wellhead and innermost casing hanger is bridged and sealed properly.

A mudline suspension system is run with a jack-up drilling vessel which is ocean bottom supported, i.e., is a stationary drilling rig. Since the rig is not moving, the outer conductor pipe strings and inner casing strings are suspended at or near the mudline and run from the mudline up to the drilling platform. Thus, the wellhead is effectively above the platform where land-type blowout preventers are installed for pressure control during drilling operations.

A subsea wellhead system is run from a floating drilling vessel which is subject to wind, waves, and heave. Thus, motion compensators, one or more ball or flexible joints, and marine riser strings are used to account for all movements of the floating vessel.

Although the two drilling operations are distinct, it is sometimes desirable to convert the mudline suspension system to a subsea wellhead system. Thus, an exploratory well drilled, using the less expensive mudline suspension system, may be converted to a production well with completion equipment, i.e., a tree connected subsea. The exploratory well may also be connected by flowlines as part of a subsea multi-well system.

In order to make this conversion, it is important that the subsea wellhead that is being used for the conversion be properly tied down to the mudline suspension system. The preferred method and apparatus to tie down the wellhead to the outer conductor pipe is disclosed and claimed in the U.S. application for patent of Alandy, identified supra. Using the preferred method and apparatus, all loads are transferred from the wellhead to the outermost conductor pipe. In the practice of the instant invention, however, other methods and apparatus may be used to tie down the wellhead since this invention is directed to the adaption of the tied down wellhead to the casing within the wellhead.

It is also important in the conversion of a mudline suspension system that the innermost casing hanger be properly tied back to the already installed wellhead so that thrust loads created by test pressure across the packoff seal be reacted to the wellhead and not to the innermost casing hanger. Axial misalignment may occur due to the possible buildup of tolerances between the innermost casing hanger and the wellhead.

It is therefore an object of this invention to provide a method and apparatus used as one of the final steps in converting a mudline suspension system to a subsea wellhead system.

A more particular object of this invention is to provide a subsea wellhead already installed with a mudline hanger tieback adaptor assembly which will tie back the mudline casing hanger to the wellhead in such a manner that all thrust loads created by test pressure across the packoff seal will be reacted to the wellhead and not to the innermost casing hanger.

SUMMARY OF THE INVENTION

The method and apparatus which accomplishes the foregoing objects comprises a mudline casing hanger tieback adaptor with an adjustable load ring for connecting an installed subsea wellhead on the mudline suspension system.

The mudline casing hanger tieback adaptor includes a mudline hanger adaptor body with an adjustable load ring, a packoff nut and packoff, casing pup, and a tieback tool, all of which are lowered on a running tool to be connected to an already installed subsea wellhead and sealably connected to an already installed casing hanger on the innermost casing of the mudline suspension system. After connecting and sealing the tieback tool to the innermost casing hanger, the adjustable load ring is rotated down onto a shoulder on the installed wellhead. The adjustability of the load ring by relative movement with respect to the mudline hanger adaptor compensates for any tolerance buildup in the already installed casing and shouldering the load ring on the wellhead transfers the load imposed on the innermost tieback tool and casing hanger back to the wellhead during the high pressure testing of the seal between the tieback tool and casing hanger. Thereafter, the annulus between the mudline casing hanger tieback adaptor and the wellhead is sealed by setting the packoff and the latter is locked down by an adaptor lockdown mechanism threaded into the bore of the wellhead.

The importance of the mudline casing hanger tieback adaptor with the adjustable load ring in the conversion of a mudline suspension system to a subsea wellhead system is apparent, and other advantages of this method and apparatus will be apparent to those skilled in the art after having studied the accompanying drawings and the following Detailed Description.

DETAILED DESCRIPTION

Figure 1:
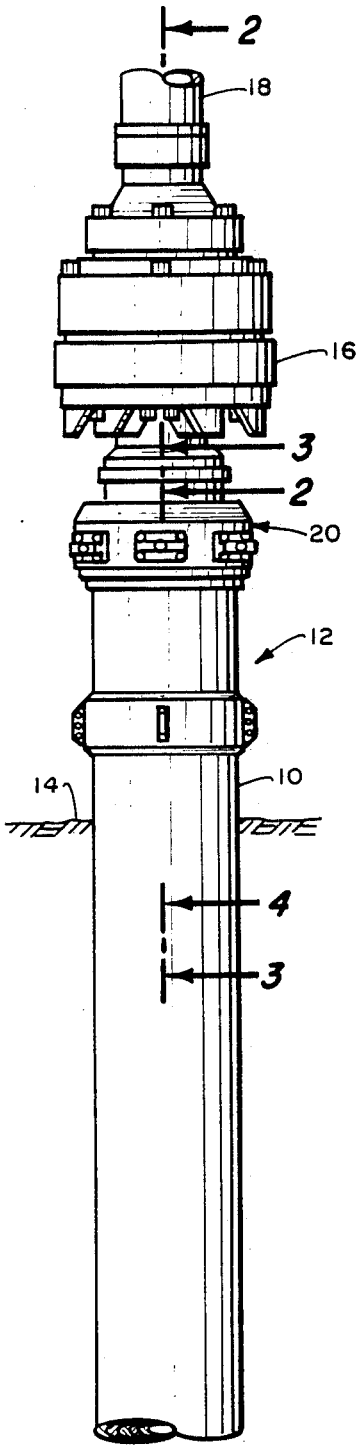
FIG. 1 is an elevational view illustrating the mudline system, including a lockdown connector and a hydraulically actuated connector for connecting the mudline system to the platform for later well operations.

As shown in FIG. 1, an outer conductor pipe 10 of the mudline suspension system, indicated in its entirety as 12, located at the mudline 14, is shown with a hydraulically actuated connector 16. The latter connects the mudline system to the platform through tubing 18 after the subsea wellhead has been connected to the mudline system as part of the conversion of the mudline system to a wellhead system.

This outer conductor pipe 10 has been cemented in a previously drilled hole in the ocean floor, is conventionally a pipe 30" in diameter, and is part of the first conductor pipe run into the well bore and cemented in place. This figure also shows a lockdown connector 20. How this latter piece of equipment is used is shown and described in the U.S. application for patent by Alandy, supra, but will also be described later herein.

The shown outer conductor pipe 10 was originally made up of several lengths of such pipe, connected together, and extending from the mudline to the platform of the stationary drilling rig.

Each conductor pipe 10 making up the string was preferably connected by a pin and box connection, such as shown in the U.S. Pat. No. 3,381,983, to Hanes, entitled "Connectable and Disconnectable Tool Joints" or the U.S. Pat. No. 3,606,393, to Huntsinger, et al, entitled "Pipe Connectors". The pin portion 22, sometimes referred to simply as pin 22, of the connector is shown in FIG. 3.

After the 30" outer conductor 10 is cemented in place, the standard practice is to drill smaller and deeper holes and then run additional and smaller casing strings using suitable running tools. These casing strings are conventionally suspended at the mudline and cemented in place utilizing conventional techniques. Typically, the next inner casing, after positioning the 30" outer conductor 10, is a 20" casing 24, then a third 13⅜" casing 26. Thereafter, a 9⅝" casing 30 and a 7" casing 32 are suspended in the conventional manner and cemented in place. At each step after cementing the outer conductor pipe 10 in place, the annular space between the casing strings is sealed and tested.

Figure 3:
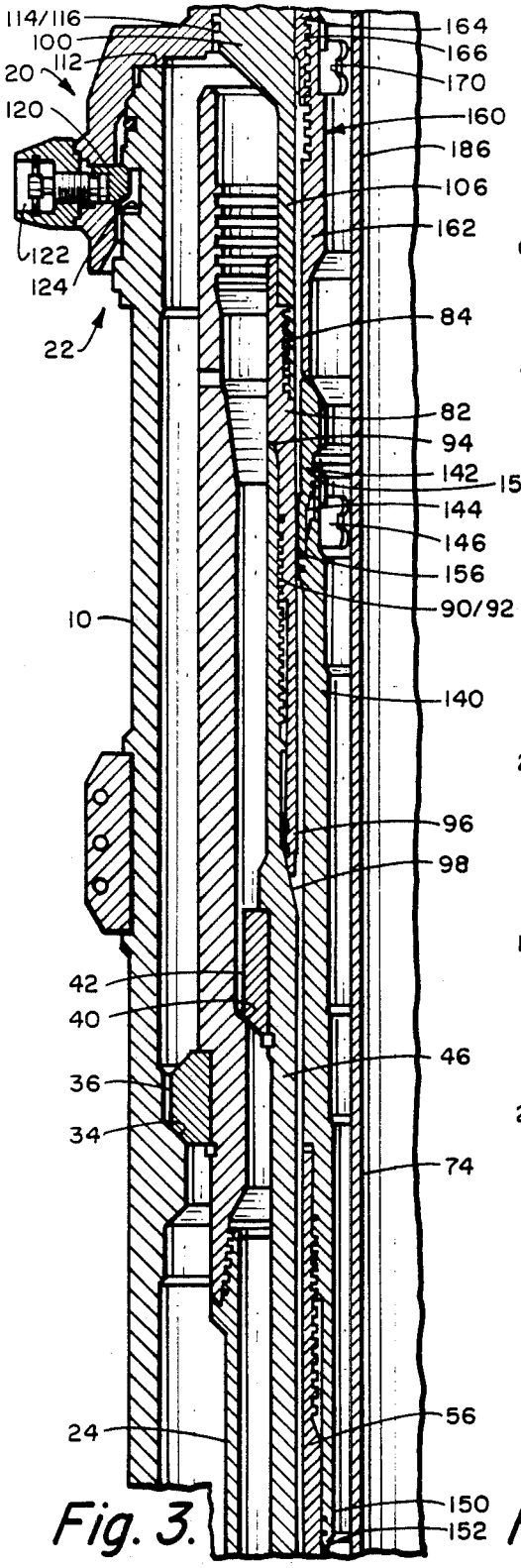
Figure 4:
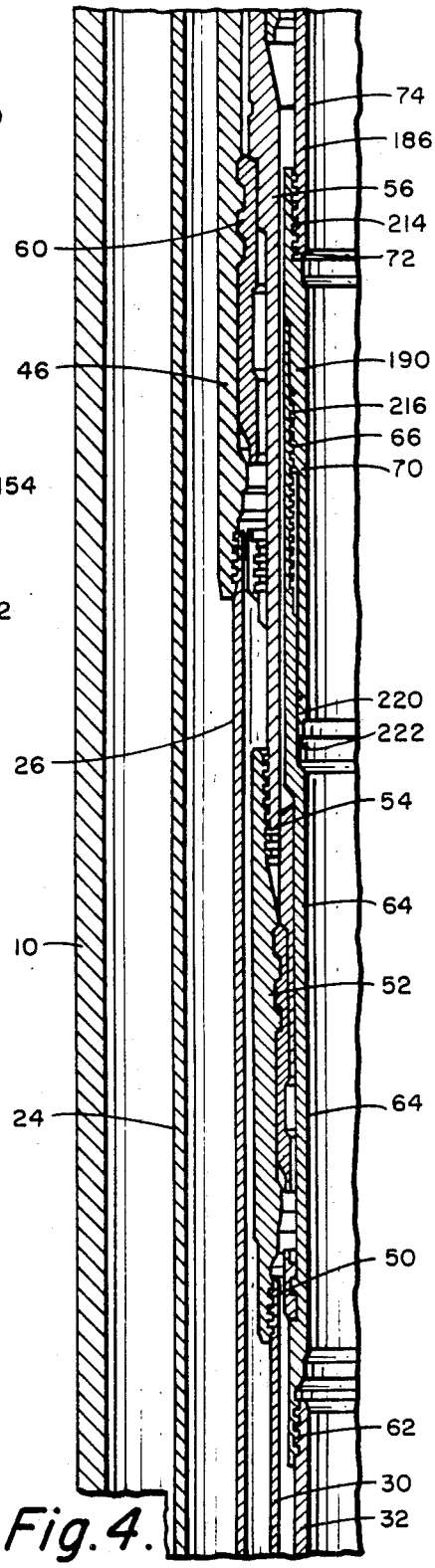

FIGS. 3 and 4 illustrate the second 20" casing 24 having landed and supported on an inner profile 34 on the outer conductor 10 by a landing ring 36, as is conventional. The 13⅜" casing 26 is also shown supported by the casing 24 on a profile 40 and landing ring 42 on a casing hanger 46, as is conventional. The next inner 9⅝" casing 30 is threaded at 50 onto a hanger sub 52 which, in turn, is threaded at 54 to the lower end of a casing hanger 56. Casing hanger 56 is suspended on the casing hanger 46 by a collet 60 in the conventional manner. The 7" casing 32 is threaded at 62 to a 7" casing hanger 64 and the latter is threaded at 66 to a standard tieback tool 70. Tool 70 is threaded at 72 to an adaptor 74 to be described.

Thus, all necessary casing and tieback tools have been run, landed, and cemented by suitable running tools to make a complete mudline suspension system. Thereafter, a corrosion cap is installed. The system thus far described is conventional and well-known.

When it is decided to make the conversion to the subsea well system, the corrosion cap, tools, and all inner casings above the mudline are removed leaving only that inner casing which had been cemented in place at the mudline. The outer conductor string, made up of the segments of conductor pipe 10, remain intact.

The next step is to run a mudline wellhead adaptor 80, sometimes referred to simply as wellhead 80, and tieback tool 82 on a running tool, connected to drill pipe, through the string of conductor pipes 10, to the 13⅜" casing hanger 46 and to thread the tool onto the casing hanger 46 and to test the seal therebetween. The lower end of wellhead 80 is threadably connected at 84 to the top of the tieback tool 82 when the two are lowered by the running tool. The wellhead has J-slots 86, shown in FIG. 2, for attachment to the running tool.

The tieback tool 82 is a sleeve which will connect wellhead 80 to the 13⅜" casing hanger 46 and, in addition to threads 84, is provided with internal threads 90 midway thereof for mating with external threads 92 below the top 94 or mouth of the 13⅜" casing hanger 46. The tieback tool is provided with a metal-to-metal seal assembly 96 which engages a tapered surface 98 on the inner periphery of the 13⅜" casing hanger 46, and when the tieback tool 82 has landed and is threaded onto the casing, the tieback tool 82 will be shouldered on the top of the casing hanger and the metal-to-metal seal will be made up. In this position, the integrity of the seal assembly 96 is tested.

Figure 2:
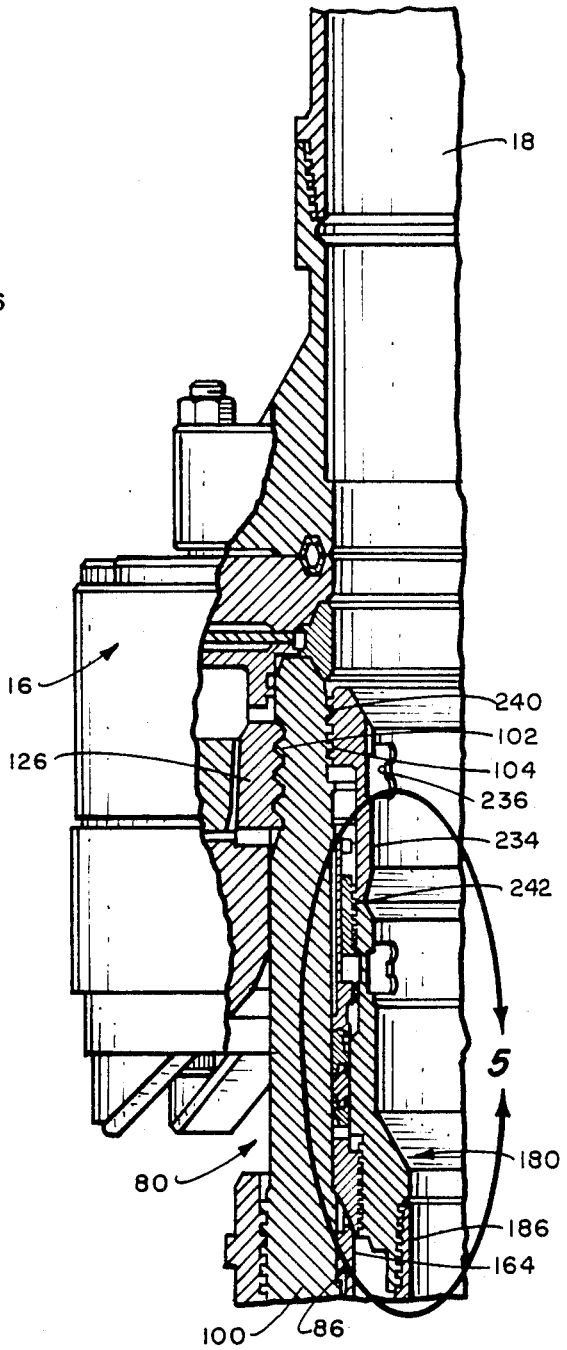
FIG. 2 is an enlarged cross-sectional view, taken along line 2—2 of FIG. 1 and partially broken away to show details thereof, FIG. 3 incorporates the lower part of FIG. 2 to illustrate the lockdown connector connected between the wellhead and the outermost conductor pipe, as well as inner casing within the outermost conductor pipe, FIG. 4, taken along line 4—4 of FIG. 1, is an extension of FIG. 3 to illustrate details of the wellhead system.

This wellhead 80 is conventional in shape in its main upper body portion 100; that is, it is provided with a profile 102 on the outer periphery thereof, for connection to the connector 16, as shown in FIG. 2. The profile is a series of grooves formed a short distance below the top or nose of the wellhead. The wellhead is further provided with internal threads 104 on its inner bore for tieback and running tools. For this system, however, the main body portion 100 is provided a downward thinner extension 106 formed by reducing the outer diameter of the wellhead. This latter extension 106 has the threads by which it is connected 84 to the top of the tieback tool, as shown in FIG. 3.

The next step in the conversion is to disconnect all of the conductor pipes 10 of the string above the mudline, leaving only the pin 22, as mentioned above.

As explained in the related U.S. application for patent of Alandy, supra, the next step is to prepare the pin 22 to receive the lockdown connector 20 which will appropriately connect the wellhead 80 to the outer conductor pipe 10 and effectively transfer all axial and radial loads imposed on the wellhead to the outer conductor pipe. As explained, the lockdown connector 20 is first preloaded on top 112 of the pin 22 by the threads 114 and 116 on the wellhead 80 and lockdown connector 20, respectively, and then connected radially to the pin 22 by dogs 120 of the bolt/dog assemblies 122 urged into groove 124. As mentioned previously, the use of the lockdown connector 20 is preferred, but in the practice of the instant invention, any means may be provided so long as the wellhead 80 is appropriately tied down into the mudline system.

Next, to connect the now partially converted mudline suspension system to a platform, the hydraulically actuated connector 16 is lowered via tubing 18 and connected to the wellhead 80. This connector includes hydraulically actuated dogs 126 which engage the profile 102 on the upper end of the wellhead 80 and essentially locks the wellhead to the tubing 18. This connector 16 is disclosed and claimed in the U.S. Pat. No. 3,321,217 of Ahlstone, to which reference is made if further details are thought necessary. This is a well-known connector used extensively in subsea systems.

The tubing 18, connected by the connector 16 to the wellhead 80, is run back to the platform and serves as a centralizing device for later operations. In this instance, a mudline hanger adaptor 140 with a packoff nut 142 and a packoff seal 144, are run on a running tool which engages the J-slots 146 in the adaptor 140. The mudline hanger adaptor 140 is a sleeve with a metal-to-mctal seal assembly 150 on its lower end which engages a tapered shoulder 152 on a casing hanger 56. The seal assembly 150 and shoulder 152 are similar to the seal assembly and tapered surface 96 and 98, and cooperate in the same manner, as explained, supra.

The metal-to-metal seal 150/152 is then tested and, if verified, the running tool is then pulled out of the J-slot 146 to then engage the packing nut 142. The packing nut is rotated threading the packing nut on threads 154 to set the packoff 144 in the conventional manner in the annulus 156. This isolates the 13⅜" casing 26 from the 9⅝" casing 30.

Having tested the the seal of the packoff seal 144, the next step is to run an adaptor lockdown mechanism 160 which will lock the adaptor 140 to the wellhead 80.

To do this, the running tool, which lowered the mudline hanger adaptor 140, is withdrawn and the adaptor lockdown mechanism 160 is lowered on the same running tool. The adaptor lockdown mechanism 160 comprises two sleeves 162 and 164. The sleeve 162 threadably telescopes within sleeve 164, as shown at 166, with J-slots 170 therein for engagement with the running tool and sleeve 164 has J-lugs 172 which engage the J-slots 86 in the wellhead 80, as more clearly shown in FIG. 5. The sleeve 162 is slideable in the J-slots 170 and lowered into engagement with the top of the packoff nut 142 by the action of the threads 166 and the interaction of the J-lugs and J-slots 172 and 86 which prevent rotation of the sleeve, but allow axial movement. At this time, only a nominal amount of torque is applied to the adaptor so as to lock down the mudline hanger adaptor 140. This prevents upward movement of the adaptor 140 and packoff seal 144 caused by casing expansion due to change in temperature when production of the well is started.

After this is accomplished, a mudline casing hanger tieback adaptor 180 is run into the wellhead.

Figure 5:
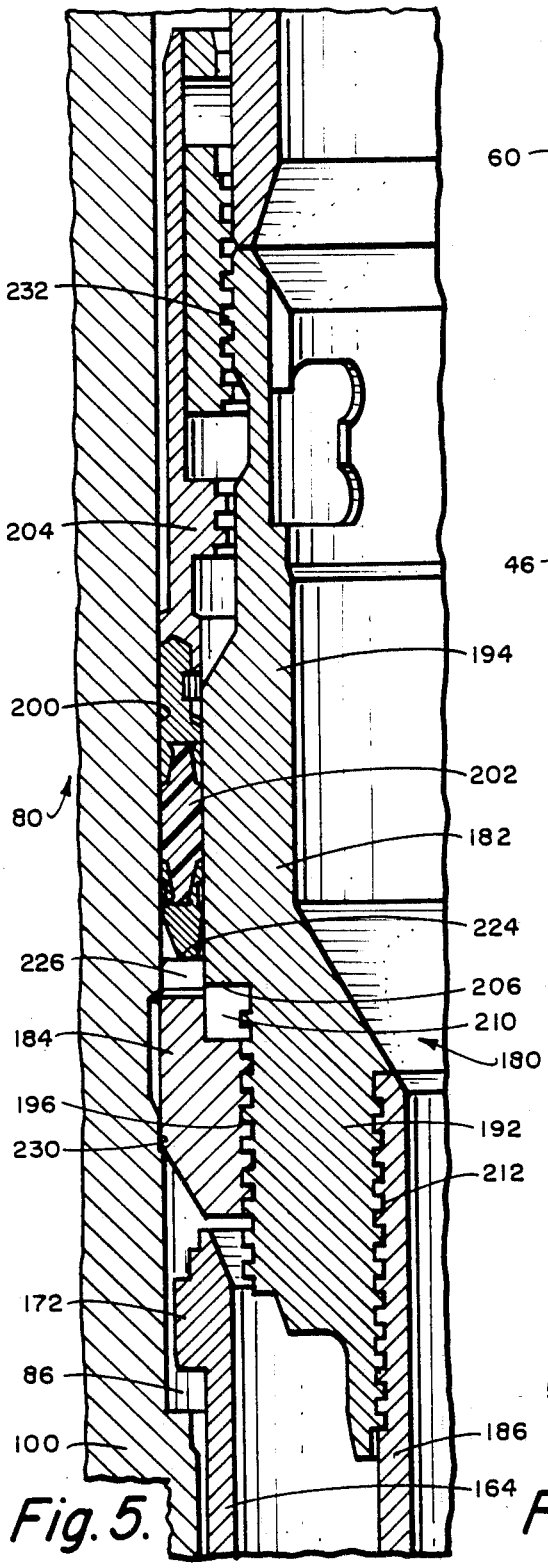
FIG. 5 is an enlargement of the area, defined by the arrow 5 in FIG. 2, to illustrate the mudline casing hanger tieback adaptor and adjustable load ring in more detail.
Figure 6:
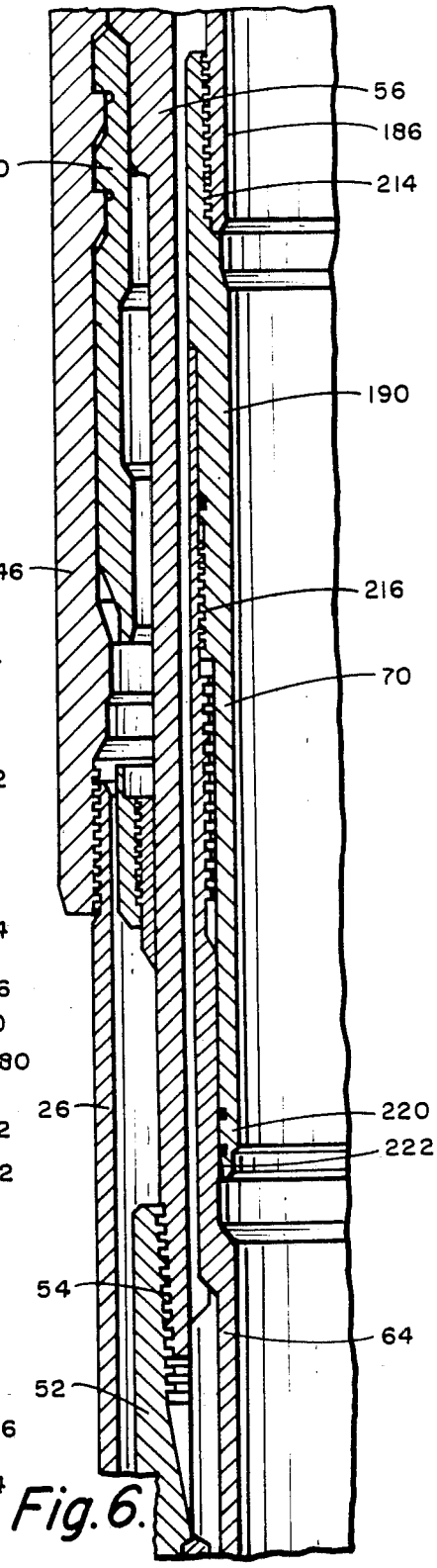
FIG. 6 is an enlargement of the area of the tieback tool and casing hanger to show both more clearly.

As more clearly shown in FIGS. 5 and 6, the mudline casing hanger tieback adaptor 180 comprises an adaptor body 182 with an adjustable load ring 184 and a casing pup joint 186 (FIG. 6) which is connected to a standard tieback tool 190.

The adaptor body 182 is similar in cross-sectional form to a standard casing hanger, that is, it has a thicker lower body portion 192 and a thinner upper portion 194 to essentially bridge the space between the bore of the wellhead 80 and the innermost casing bore which, in this instance, is a 7" casing identified as 32 previously.

The adaptor body 182 is spaced from the inner bore of the wellhead 80 by the thickness of the adjustable load ring 184 which is threaded in a recess in the lower body portion by inter-engaging internal and external threads 196. The thickness of the load ring provides an annulus 200 of the conventional type between the bore of the wellhead 80 and the adaptor body which will be sealed by packoff assembly 202 by actuation of a packoff nut 204 at the appropriate time as will be described. The packoff assembly 202 and packoff nut are not in the wellhead bore at the time the mudline casing hanger tieback adaptor is installed even though shown as such in FIG. 5

When the mudline casing hanger tieback adaptor 180 is lowered on the running tool, the adjustable load ring 184 is fully threaded on the hanger body and into engagement with the shoulder 206, that is, gap 210, as shown in the drawings, is closed.

The casing pup joint 186 is a sleeve internally threaded at both ends with the top end threaded onto the mudline adaptor body as at 212 and the bottom end threaded onto the tieback tool 190 as at 214. The tieback tool 190 is, in turn, threaded as at 216 onto the mudline casing hanger 64.

The lower end of the tieback tool 190 is provided with a metal-to-metal seal assembly 220 which engages a tapered surface 222 on the casing hanger. The function of this seal 220/222 is the same as the previously described seals 96/98 and 150/152.

Thus described, the mudline casing hanger tieback adaptor 180 is considered fully landed, and so the running tool used to lower the adaptor is withdrawn and another tool, not shown, is run into the well bore. This tool is a sleeve-type tool run on drill pipe and capable of being inserted in the annulus 200 between the well bore 80 and the upper portion 194 of the adaptor body. This tool has downwardly extending lugs which will engage a plurality of grooves 224 formed on the top of the adjustable load ring 184 (only one such groove 226 being shown in FIG. 5). This tool will rotate the adjustable load ring 184 into engagement with a shoulder 230 on the inner bore of the wellhead and, thus, provide the means for transferring load on the inner casing 32, tieback tool 190, and casing hanger 64 when the seal assembly is tested.

The tool for rotating the adjustable load ring is then removed from the annulus 20 and another running tool is used to lower the packoff assembly 202 and packoff nut 204 into the annulus, as shown in FIG. 5, where the packoff nut 204 is threaded downwardly with respect to the well bore and adaptor body on inter-engaging threads 232 to engage the top 224 of the adjustable load ring to set the packoff in the conventional manner. The packoff is conventional and is more fully described in the U.S. Pat. No. 3,797,874, and others, to which reference is made if necessary for more detailed information.

The packoff seal is then tested by a tool which sealing engages above and below the packoff in the conventional manner. This puts a downward load on the mudline casing hanger adaptor 180 which is transferred to the wellhead by the adjustable load ring.

Thereafter, the running tool, used to lower the casing hanger tieback adaptor 180, is again used to lower an adaptor lockdown mechanism 234 (FIG. 2) into the wellhead bore. The adaptor lockdown mechanism 234 is a sleeve provided with J-slots 236 for engagement with the running tool and also provided with external threads 240 to engage threads 104 on the wellhead. Rotation of the sleeve 234 by the running tool will cause the sleeve to engage the top 242 of the tieback adaptor body and prevent any upward movement of the adaptor body due to casing expansion.

From the foregoing it can be seen that there is provided a mudline casing hanger tieback adaptor 180 with an adjustable load ring by which the adjustability of the load ring compensates for any tolerance buildup in the already installed casing and the shouldering of the load ring on the wellhead transfers the load imposed on the innermost tieback tool and casing hanger back to the wellhead during high pressure testing of the seal assembly between the tieback tool and casing hanger.

I claim:

1. A mudline casing hanger tieback adaptor means for use in a mudline suspension system having a subsea wellhead with an inner bore and a plurality of concentric casing disposed within an outer tubular member comprising, sealing means for sealably engaging the innermost of said concentric casing, engaging means connected to said sealing means for engaging the inner bore of said wellhead, said engaging means being axially moveable with respect to said wellhead to engage supporting means on said wellhead and thus support said sealing means and provide adjustment means between said wellhead and said sealing means when said engaging means is within said inner bore.

2. The adaptor means as claimed in claim 1 wherein said engaging means includes an adaptor body insertable in said wellhead but spaced therefrom to provide an annulus therebetween, and wherein said engaging means comprises an adjustment ring on said adaptor body and bridging the space between said wellhead bore and said adaptor body and threaded on said adaptor body whereby rotation of said adjustment ring will lower said adjustment ring into engagement with said supporting means on said wellhead, said adjustment ring being rotatable when said adaptor body is within said inner bore.

3. The adaptor means as claimed in claim 2 further including a packing nut and a seal means insertable in said annulus and energizeable to seal the annulus.

4. The adaptor means as claimed in claim 3 further including a lockdown mechanism for holding said adaptor means against upward movement.

5. The adaptor means as claimed in claim 4 including a tieback tool for connecting said adaptor body to said innermost casing and a cylindrical extension for connecting said adaptor body to said tieback tool.

6. In a mudline suspension system which has been partially converted to a subsea well system by having a tubular wellhead locked down within an outer tubular member, and concentric casing having been positioned within said tubular member, the improvement comprising, a mudline casing hanger tieback adaptor having means for sealably engaging the innermost of said concentric casing and means for engaging said wellhead; and further including means for adjustably compensating for any variation in axial distance between engaging means on said wellhead and said sealing means when positioned in said innermost casing and for transferring loads imposed upon said innermost casing and adaptor means to said wellhead.

7. The improvement as claimed in claim 6 wherein said adaptor means includes an adaptor body and a tieback tool, said tieback tool having said sealing means therein and an adjustment ring threadably moveable with respect to said wellhead and said adaptor body so as to engage a support on said wellhead to support said adaptor means within said well bore.

8. The improvement as claimed in claim 7 wherein said adaptor body is spaced from said wellhead to define an annulus, said adjustable ring bridging the distance between said adaptor body and said wellhead, and sealing means for sealing said annulus.

9. The improvement as claimed in claim 8 wherein said sealing means includes a packoff nut coupled to a packoff sealing means, said packoff nut being moveable downwardly to urge said packoff sealing means into engagement with the top of said adjustable rings to expand said packoff sealing means within said annulus.

10. The improvement as claimed in claim 9 further including means insertable within said well bore for locking said adaptor body against axial movement out of said well bore.

11. A method of adapting a partially converted mudline suspension system, the conversion including a wellhead positioned within an outer tubular member forming part of said mudline suspension system and including the steps of:

lowering mudline casing adaptor means which includes means for adjusting for any variation in length between said wellhead and a casing hanger on the inner most casing remaining in said wellhead while said adaptor means is within said wellhead, sealing said adaptor means to the casing hanger, causing said adaptor means to engage a support means on said wellhead, and thus be positioned axially within said wellhead.

12. The method as claimed in claim 11 further including the steps of providing a fluid tight seal between said adaptor means and said wellhead.

13. The method as claimed in claim 12 further including the steps of locking said adaptor means within said wellhead against movement upward out of said wellhead.

* * * * *